United States Patent [19]

Hill

[11] Patent Number: 4,473,946

[45] Date of Patent: Oct. 2, 1984

[54] PYROGRAPHIC IRON TIP

[76] Inventor: Richard L. Hill, 375 Phillips St., Hanson, Mass. 02341

[21] Appl. No.: 482,532

[22] Filed: Apr. 6, 1983

[51] Int. Cl.[3] ..... B26B 11/00

[52] U.S. Cl. ..... 30/140; 30/164.9; 30/172; 144/2 R; 144/360; 144/364; 145/1 R

[58] Field of Search ..... 144/2 R, 380, 360, 364; 145/1 R; 30/140, 164.8, 164.9, 172

[56] References Cited

U.S. PATENT DOCUMENTS 2,600,067 6/1952 Merodian ..... 30/140 X

*Primary Examiner*—W. D. Bray

*Attorney, Agent, or Firm*—James H. Grover

[57] ABSTRACT

A pyrographic iron for sculpting fine feather barbs on a realistic wooden bird carving uses interchangeable tips slide fitting on the irons. The tips have a head with a flat surface tapered toward one or two outer edges, the surface having from 3 to 100 serrations per inch extending outwardly on the head to the outward edge or edges. The serrations form crests and valleys, the crests charring the barb lines and the valleys limiting the depth of charring.

19 Claims, 7 Drawing Figures

PYROGRAPHIC IRON TIP

BACKGROUND

In the native American art of carving wild birds in wood the techniques for achieving lifelike feather texture have been refined to the extent of marking the individual barbs or flue which branch from the quills of individual feathers. After the body of the bird has been shaped, the individual feathers outlined and the quill line defined, the wedge shaped tip on an electric pyrographic or woodburning electric iron similar to a small soldering iron is stroked away from the quill. The tip previously used is shaped like a wood turning skew blade with a triangular cross section forming a single somewhat sharp ridge extending at an angle to the axis of the iron to an outer point. Repeated strokes of the heated tip individually mark a series of barbs growing out of the quill. Because the iron is used for several carving effects variously shaped, interchangeable tips are provided with a hollow shank which slide fits over a heated rod extending from the handle of the iron. Typically the shank is longitudinally split so as to be contracted and sprung inwardly on the rod by an encircling spring clamp. The heated iron rod is usually composed of high carbon steel or copper which burn out after a relatively short life.

With small bird carvings it is desirable, for reproducing feather barbs life size, to mark the barbs at a spacing as close as forty or more lines per inch. The handful of American artists capable of manually achieving such a fine spacing must spend many hours marking the feathers of even a bird the small size of a chickadee. Although some unevenness in spacing is natural, generally the barbs should be parallel and equally spaced, particularly on the wings and back. Also the depth to which a feather is charred each side of a barb should be reasonably even or continuous from barb to barb along a quill.

It is impractically painstaking and time consuming to mark barbs of a bird feather at any spacing over ten barbs per inch with naturally appearing parallelism and depth of the barbs with the presently available pyrographic tip, and it is the object of the present invention to provide a pyrographic tip which will mark feather barbs on carved birds at fine spacings beyond human skill with prior tips, and with natural appearing regularity and parallelism and other improvements in appearance and reduction of working time.

SUMMARY OF THE INVENTION

According to the invention a tip for a pyrographic iron comprises a body fitting on the iron and having a longitudinal axis; and a burning head on the body including a flat surface facing away from the body at an acute angle to the axis of the body and having a plurality of parallel serrations extending outwardly of the head to at least one substantially straight outer edge, the serrations forming angular charring crests and valleys which limit the depth of marking charred lines in a heat-oxidizable material.

Preferably the serrations on the surface extend to two outer left and right edges which converge toward the axis of the body symmetrically on the body axis.

DRAWING

DESCRIPTION

Figure 1:
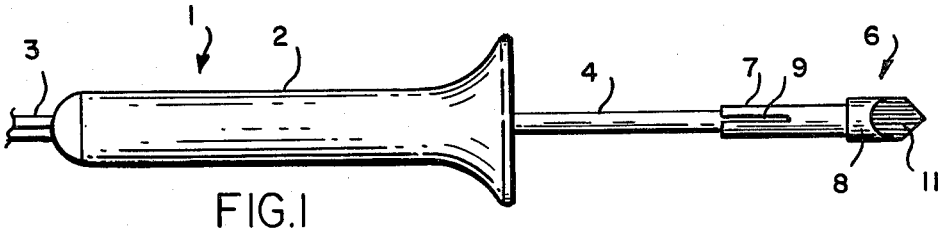
FIG. 1 is an under plan view of a pyrographic iron with a tip according to the invention.
Figure 2:
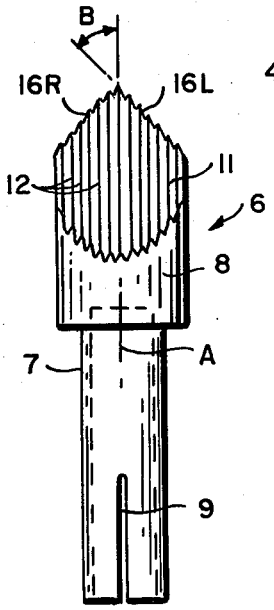
FIGS. 2 and 3 are enlarged plan and side views of the tip of FIG. 1.
Figure 3:
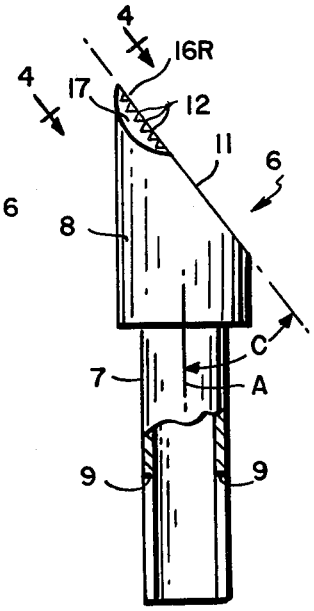

FIG. 1 shows a typical pyrographic pen 1 used in American wood carving of birds. It consists of a handle 1 into which a two-wire electric cord 3 runs from a power outlet to a cylindrical steel rod heated by an internal heater element (not shown) at its outer end over which is an interchangeable tip 6. The tip 6, which is the subject of the present invention, has a cylindrical body with a tubular shank 7 and a burning head 8 on an axis A. The shank 7 has a longitudinal slit 9 giving the shank a resilient slide fit on the heater rod 4 of the iron.

Prior interchangeable tips were of high carbon steel or copper with a coefficient of thermal expansion approximately equal to or greater than the coefficient of the heater rod 4 and thus expanded with heat more than the heater rod and required an encircling spring clamp to hold the tip firmly on the heated rod. In contrast the body of the present tip, including the shank, is machined from a rod of metal with a lower thermal coefficient of expansion than that of the heater element so that when the iron is cold the tip easily fits and slides on the heater element, but when the iron is heated its heater rod expands to a tight fit with the tip holding the tip tightly on the rod in use. For example, the tip is stainless steel which has not only a substantially lower coefficient of expansion than the high carbon steels or copper and its alloys used for the heater rod, but also has such a low or negligible carbon content that its burning time is several times longer before burn out than prior tips.

At the outer end of the interchangeable tip head 8 of FIGS. 1 to 5 is a flat, serrated surface 11 inclined at an acute angle C, preferably about 35° to the axis A of the body. A plurality of parallel serrations 12 form angular crests 13 and valleys 14 which extend outwardly of the head 11 in planes parallel to each other and to the axis A of the body. The serrations 12 extend to two preferably straight axially outward edges 16R and 16L which converge toward a point symmetrical on the body axis at an angle B of about 45° to the head axis A. For a right handed sculptor the edges 16R and 16L will align conveniently for marking feather barbs on the right and left sides respectively of a bird carving. To sculpt feather barbs pyrographically the iron and tip are brought to a correct temperature controlled by an iron such as the Model WB-1 Hot Tool manufactured by Hot Tools, Inc., Marblehead, Mass. The left or right edge 16L or 16R is then pressed lightly at the quill line of a feather and drawn a short stroke outwardly from the quill to the margin of the feather to mark a series of parallel, equally spaced barb crests and darker intervening grooves. The tip is then moved along the feather and the last serration of the edge is fitted in the last groove of a previously charred series which guides the next stroke of the tip parallel to the previous series assuring that the barbs not only within a series but also in adjacent series will be parallel.

Figure 4:
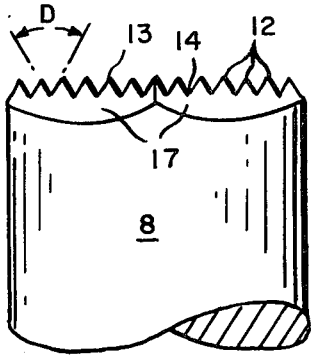
FIG. 4 is a further enlarged view of the tip from line 4—4 of FIG. 3.
Figure 5:
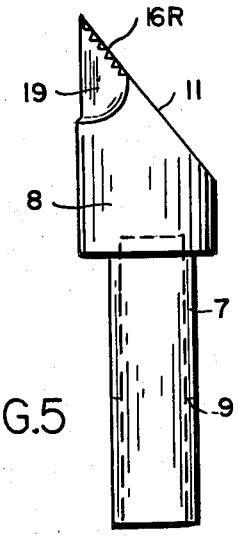
FIG. 5 is a side view, like FIG. 3, of another form of tip.

The individual serrations are triangular in cross section, the included angle D of the crest 13 being preferably approximately 90° as shown in FIG. 4. The full depth of the serrations is exposed at the edges by a champfer 17 along each edge (FIGS. 3 and 4) or by undercuts 19 (of which one is shown in FIG. 5) in the cylindrical head B of the body of the tip. By virtue of the inclination of the serrated surface 11 the cross section of the head 8 reduces outwardly of the head to permit the edges 16R and 16L to be inserted under the margin of one feather when marking barbs on an underlying feather. The under cuts 19 of FIG. 5 are flats which further slim the taper toward the edges 16R and 16L.

Whereas the outer margin of one feather marking the beginning of the barbs of the underlying feather has been hitherto separately carved out or burned prior to masking the underlying barbs, the need for such premarking of the feather margin is eliminated by use of the present serrated tip. The edge 16R and 16L forms a line which will, at the beginning of a barb marking stroke, also delineate the margin of the overlying feather. This delineation is accentuated by very slightly inclining the serrated surface up from the carving using the edge 16R and 16L as a pivot.

Whether the serrated surface lies flat on the carving or is inclined to it the valleys 14 of the serrations control the depth to which the crests can char into the wood. With the single wedge or blade of previous pyrographic iron tips depth of charring depends on manual control and the singly marked barb lines are marked so deeply as to vary widely in width, overlap adjacent lines and blur the delineation of individual barbs. Use of the present multiply serrated tip insures that adjacent barb lines are clearly spaced and of reasonably uniform width.

Figure 6:
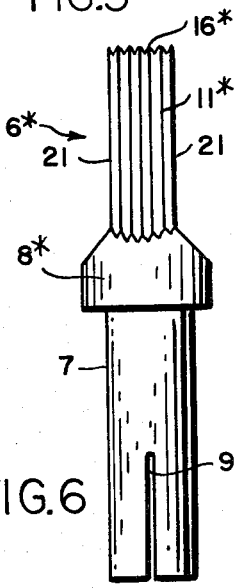
FIGS. 6 and 7 are plan and side views, like FIGS. 2 and 3, of still further a form of tip.
Figure 7:
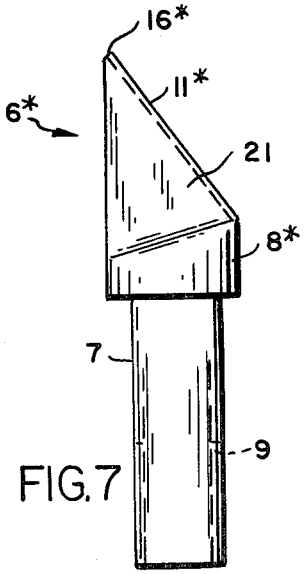

The present pyrographic tip not only greatly improves the uniformity and controlled depth of marking feather barbs of a bird carving but also makes possible marking barbs of a close spacing and fineness actually or practically beyond human skill. Even the most skilled bird sculptor cannot, with a single blade tip, economically mark barbs closer than more than forty to the inch over a very small bird. The present multiple serration tip allows a moderately skilled bird carver to mark barbs at spacings from 10 to 100 barbs per inch with surfaces having the same range of serrations per inch. This range of 10 to 100 is one decimal order and includes spacings of 48, 56 and 64 serrations per inch which are well beyond human skill but are easily obtained with the present pyrographic tip and useful in carving small birds. Typically the head of a tip is one quarter of an inch in diameter and correspondingly has from 12 to 16 serrations. But narrow tips used for marking breast feathers with smaller series of parallel barbs need have fewer, but at least three serrations. The tip 6* of FIGS. 6 and 7, for example, has flat sides 21 extending from a cylindrical body portion 8* to a single orthogonal outward edge 16*, 3/32 of an inch long with 3 to 10 serrations on its inclined surface 11*.

It should be understood that the present disclosure is for the purpose of illustration only and that this invention includes all modifications and equivalents which fall within the scope of the appended claims.

I claim:

1. A tip for a pyrographic iron, said tip comprising:

a body fitting on the iron and having a longitudinal axis; and a burning head on the body including a flat surface facing away from the body at an acute angle to the axis of the body and having a plurality of parallel serrations extending outwardly of the head to at least one substantially straight outer edge, the serrations forming angular charring crests and valleys which limit the depth of marking charred lines in a heat-oxidizable material.

2. A tip according to claim 1 wherein the serrated surface is flat.

3. A tip according to claim 1 wherein the serrations lie in planes parallel to each other and the axis of the body.

4. A tip according to claim 1 wherein the head reduces in cross section outwardly of the head.

5. A tip according to claim 1 wherein the serrations form a crest triangular in cross section.

6. A tip according to claim 5 wherein the included angle of the crest is approximately ninety degrees.

7. A tip according to claim 1 wherein the surface has at least three serrations.

8. A tip according to claim 1 wherein the serrations are spaced in a decimal order which includes over fifty serrations per inch.

9. A tip according to claim 1 wherein the body includes a tubular shank slide fitting on the iron.

10. A tip according to claim 9 wherein the tip has a lower coefficient of thermal expansion than the iron.

11. A tip according to claim 1 wherein the tip is a metal substantially free of carbon.

12. A tip according to claim 1 wherein the tip is of stainless steel.

13. A tip according to claim 1 wherein the serrated surface has two axially outward edges which converge toward the body axis.

14. A tip according to claim 13 wherein the edges are substantially symmetrical on the body axis.

15. A tip according to claim 13 wherein the edges converge at an angle of approximately ninety degrees.

16. A tip according to claim 13 wherein the body is cylindrical.

17. A tip according to claim 16 wherein the cylindrical surface of the body diametrically opposite the serrated surface is undercut adjacent the outward edges.

18. The apparatus according to claim 1 wherein said iron includes a cylindrical, metal heater element axially receiving the tip.

19. Apparatus according to claim 18 wherein the body of the tip has an axial bore easily slide fitting on the heater element when cold, the body of the tip being composed of a metal with a lower coefficient of thermal expansion than the metal of the heater element whereby the fit tightens as the element heats.

* * * * *